US010646097B2

(12) United States Patent
Durham et al.

(10) Patent No.: US 10,646,097 B2
(45) Date of Patent: May 12, 2020

(54) CHECK VALVE ASSEMBLY FOR A DRAIN PUMP ASSEMBLY OF A DISHWASHER APPLIANCE

(71) Applicant: Haier US Appliance Solutions, Inc., Wilmington, DE (US)

(72) Inventors: Kyle Edward Durham, Louisville, KY (US); Mark Thomas Fryman, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 193 days.

(21) Appl. No.: 15/877,539

(22) Filed: Jan. 23, 2018

(65) Prior Publication Data

US 2019/0223683 A1 Jul. 25, 2019

(51) Int. Cl.
*A47L 15/42* (2006.01)
*A47L 15/00* (2006.01)

(52) U.S. Cl.
CPC ..... *A47L 15/4217* (2013.01); *A47L 15/0086* (2013.01); *A47L 15/4204* (2013.01); *A47L 2501/01* (2013.01)

(58) Field of Classification Search
CPC ..... A47L 15/0086; A47L 15/4204; A47L 15/4217; A47L 2501/01
See application file for complete search history.

(56) References Cited

U.S. PATENT DOCUMENTS

| | | | | |
|---|---|---|---|---|
| 2,271,993 | A * | 2/1942 | Stoddard | F16K 1/2028 137/589 |
| 2,681,658 | A | 6/1954 | Meeker et al. | |
| 3,139,890 | A * | 7/1964 | Moran | A47L 15/4427 134/100.1 |
| 3,548,844 | A * | 12/1970 | Sobel | A47L 15/0065 134/57 D |
| 5,131,432 | A | 6/1992 | Santarossa et al. | |
| 6,182,674 | B1 * | 2/2001 | Jozwiak | A47L 15/0049 134/104.1 |
| 6,418,943 | B1 * | 7/2002 | Miller | A47L 15/4202 134/104.1 |
| 7,472,711 | B2 | 1/2009 | Johnson et al. | |
| 8,268,082 | B2 | 9/2012 | Elick et al. | |
| 2004/0163680 | A1 | 8/2004 | Elick et al. | |
| 2004/0163689 | A1 * | 8/2004 | Lee | A47L 15/4223 134/94.1 |
| 2004/0231720 | A1 * | 11/2004 | Ruschke | B67D 3/0029 137/202 |
| 2007/0138121 | A1 * | 6/2007 | Stribling | A47G 19/2272 215/11.4 |

(Continued)

FOREIGN PATENT DOCUMENTS

CA 2190936 A1 5/1997

*Primary Examiner* — Benjamin L Osterhout
(74) *Attorney, Agent, or Firm* — Dority & Manning, P. A.

(57) ABSTRACT

A dishwasher appliance includes a drain basin defined at a bottom of a sump of the dishwasher. The drain basin defines a discharge port and a drain pump is in fluid communication with the discharge port for selectively urging a flow of wash fluid through the discharge port to an external drain during a drain cycle. A check valve assembly includes a check valve removably positioned over the discharge port between the drain pump and the drain basin and a positioning arm attached to the check valve for positioning and locking the check valve in place.

20 Claims, 7 Drawing Sheets

(56) References Cited

U.S. PATENT DOCUMENTS

| | | | | |
|---|---|---|---|---|
| 2008/0163904 | A1* | 7/2008 | Hwang | A47L 15/4221<br>134/198 |
| 2008/0184792 | A1* | 8/2008 | Parris | F16K 47/02<br>73/276 |
| 2014/0196756 | A1* | 7/2014 | Dries | A47L 15/22<br>134/198 |

* cited by examiner

CHECK VALVE ASSEMBLY FOR A DRAIN PUMP ASSEMBLY OF A DISHWASHER APPLIANCE

FIELD OF THE INVENTION

The present disclosure relates generally to dishwasher appliances, and more particularly to improved drain systems within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a drain pump may periodically discharge soiled wash fluid that collects in the sump space and the process may be repeated.

As part of a normal drain cycle, the dishwasher uses the drain pump to discharge soiled wash fluid through a drain hose to an external drain. Notably, the external drain is typically located above the drain pump. To prevent the soiled wash fluid from flowing back into the sump of the dishwasher, conventional drain system designs position a check valve on the drain hose, e.g., downstream of the drain pump, to prevent wash fluid in the drain hose from reentering the drain pump or sump.

Notably, such a configuration results in several disadvantages. For example, the volume of soiled wash fluid that remains in the drain pump upstream of the check valve could reenter the sump and be recirculated onto the dishes during a subsequent wash cycle. In addition, to resolve drain clog issues, the check valve would need to be accessed by removing the dishwasher from the cabinet. Notably, such a procedure is time consuming and costly. In addition, because the conventional check valve prevents wash fluid from remaining in a drain volute of the drain pump, the pump may become "air locked" and require priming before effective pumping may be achieved during the next drain cycle. This priming procedure typically involves pulsing the drain pump on and off to remove air from the drain volute, which degrades sound quality and the user experience in general.

Accordingly, a dishwasher appliance that utilizes an improved check valve assembly would be useful. More specifically, a check valve assembly that prevents the backflow of soiled wash fluid, simplifies the process for removing clogs, and improves the general operation of the dishwasher appliance would be particularly beneficial.

BRIEF DESCRIPTION OF THE INVENTION

The present subject matter provides a dishwasher appliance including a drain basin defined at a bottom of a sump of the dishwasher. The drain basin defines a discharge port and a drain pump is in fluid communication with the discharge port for selectively urging a flow of wash fluid through the discharge port to an external drain during a drain cycle. A check valve assembly includes a check valve removably positioned over the discharge port between the drain pump and the drain basin and a positioning arm attached to the check valve for positioning and locking the check valve in place. Additional aspects and advantages of the invention will be set forth in part in the following description, may be apparent from the description, or may be learned through practice of the invention.

In accordance with one exemplary embodiment of the present disclosure, a dishwasher appliance defining a vertical direction is provided. The dishwasher appliance includes a wash tub that defines a wash chamber and a sump for collecting wash fluid. A drain basin is defined at a bottom of the sump, the drain basin defining a discharge port, and a drain pump is in fluid communication with the discharge port for selectively urging a flow of wash fluid through the discharge port to an external drain during a drain cycle. A check valve assembly includes a check valve removably positioned over the discharge port between the drain pump and the drain basin and a positioning arm attached to the check valve for positioning and locking the check valve in place.

In accordance with another exemplary embodiment of the present disclosure, a drain pump assembly for a dishwasher appliance is provided. The drain pump assembly includes a drain basin defined at a bottom of a sump of the dishwasher appliance, the drain basin defining a discharge port, and a drain pump in fluid communication with the discharge port for selectively urging a flow of wash fluid through the discharge port. A check valve is removably positioned over the discharge port between the drain pump and the drain basin and a positioning arm is attached to the check valve for positioning and locking the check valve in place.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
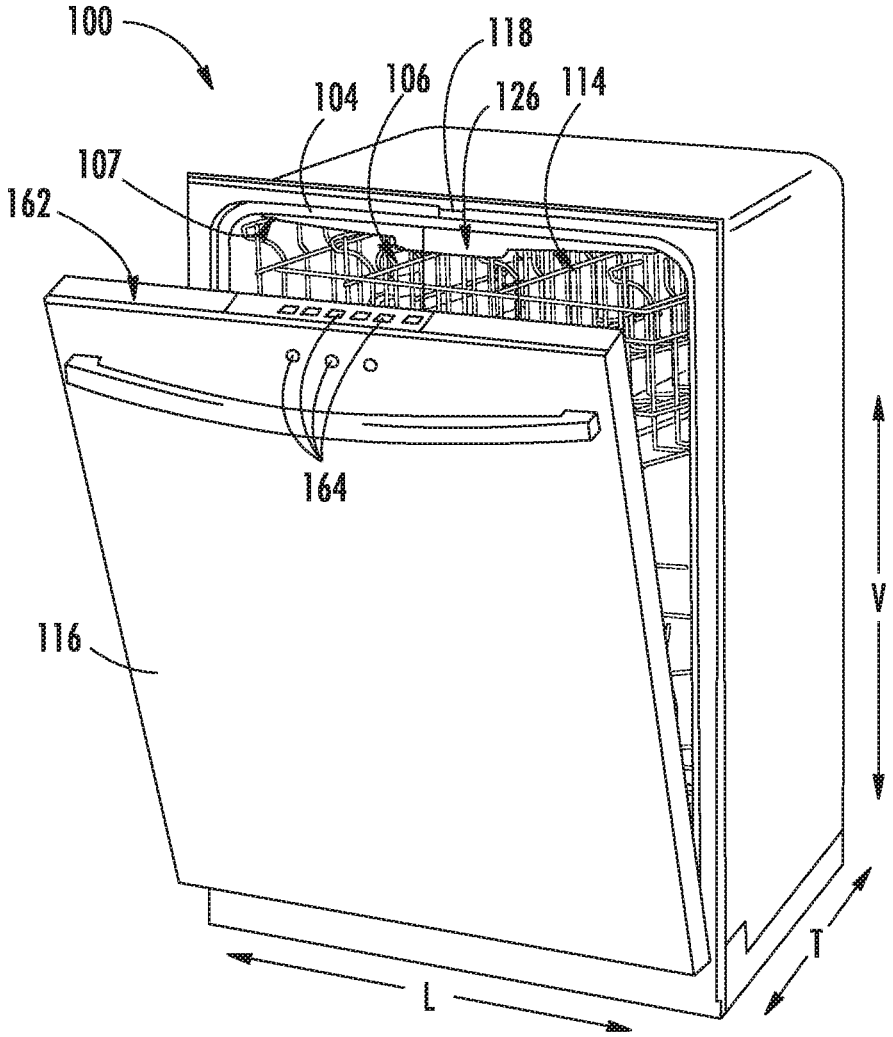
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
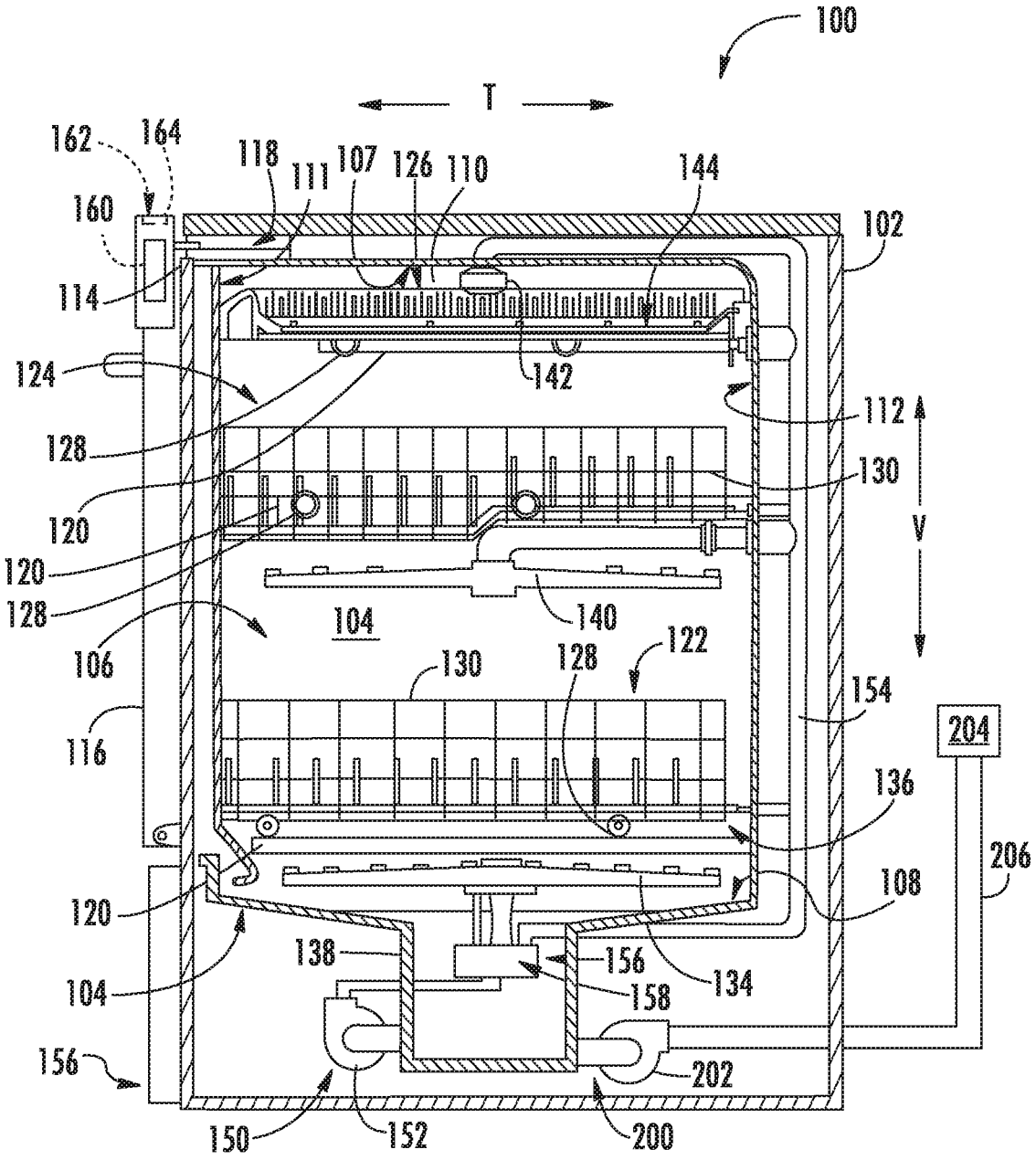
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds, e.g., during wash and/or rinse cycles. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
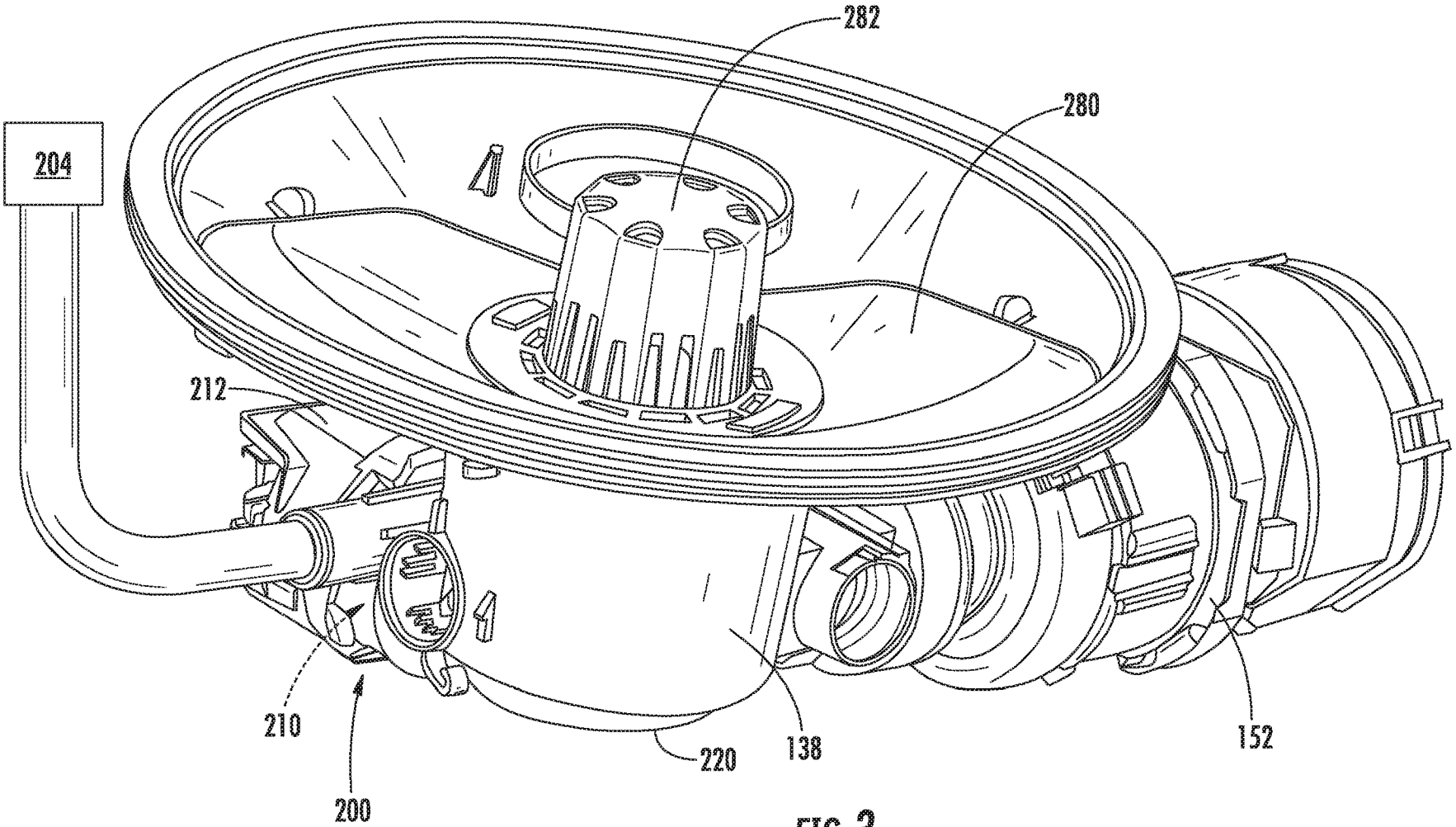
FIG. 3 provides a perspective view of a sump assembly of the exemplary dishwashing appliance of FIG. 1 according to an example embodiment of the present subject matter.
Figure 4:
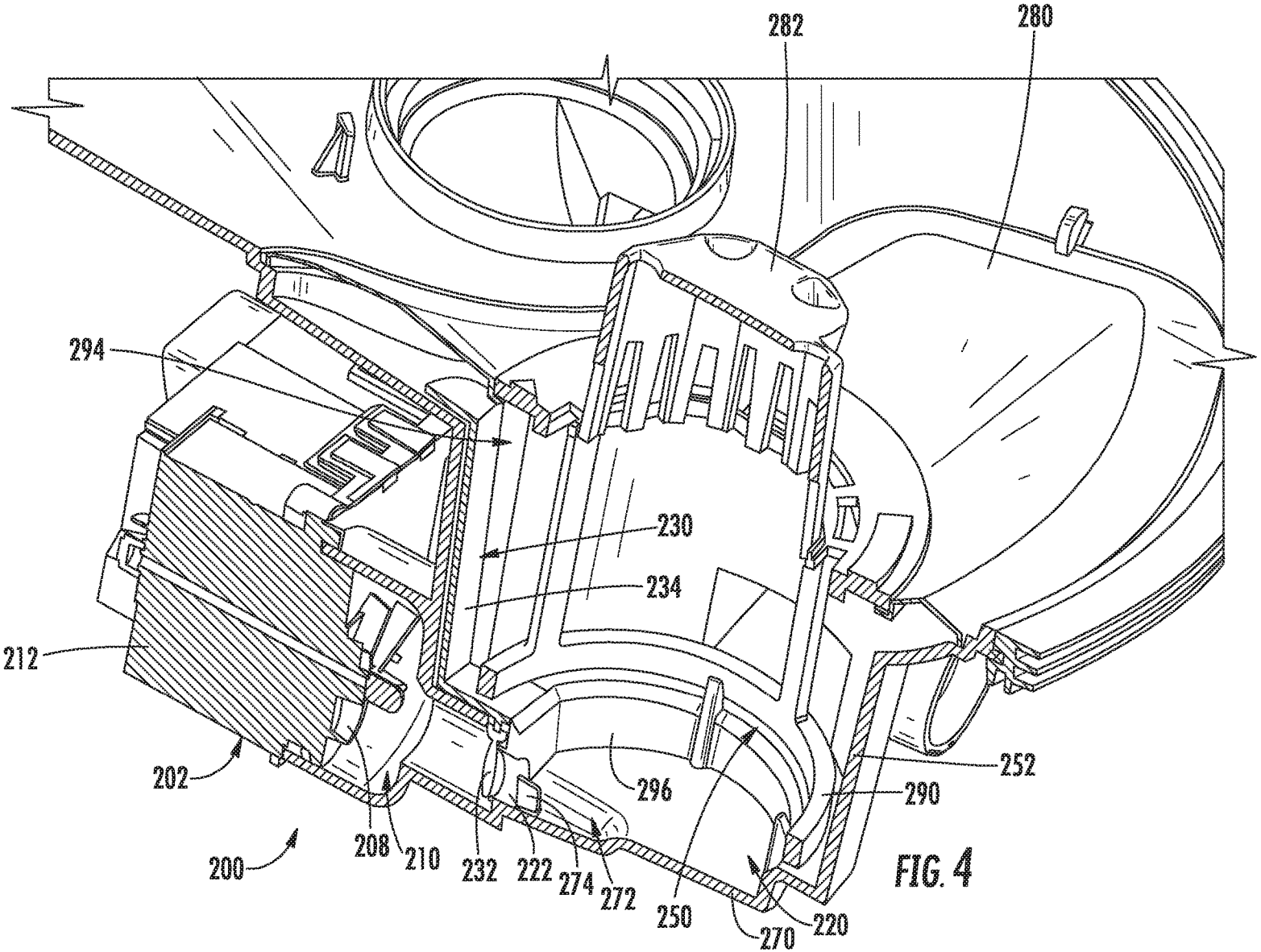
FIG. 4 provides a perspective, cross sectional view of the exemplary sump assembly of FIG. 3.

Referring now generally to FIGS. 3 and 4, a drain pump assembly 200 according to an exemplary embodiment of the present subject matter will be described. Drain pump assembly 200 may generally be configured for periodically discharging soiled wash fluid from dishwasher 100. Drain pump assembly 200 as described herein is only one exemplary configuration used for the purpose of explaining aspects of the present subject matter and is not intended to limit the scope of the invention in any manner.

Drain pump assembly 200 may generally include a drain pump 202 which is in fluid communication with sump 138 and with an external drain 204 through a drain hose 206. During a drain cycle, drain pump 202 urges a flow of soiled wash fluid from sump 138, through drain hose 206 to external drain 204. More specifically, drain pump 202 comprises a drain pump impeller 208 rotatably mounted within a drain volute 210. Drain pump 202 includes a motor 212 which is energized during a drain cycle such that drain pump impeller 208 draws wash fluid from sump 138 and urges it through drain hose 206 to external drain 204. Notably, external drain 204 is typically positioned above drain pump 202 along the vertical direction V. Therefore, soiled wash fluid pumped out of drain volute 210 but which does not reach external drain 204 has a tendency to fall under the force of gravity back toward drain volute 210 when motor 212 stops rotating drain pump impeller 208.

Referring now generally to FIGS. 4 through 7, dishwasher appliance 100 includes a drain basin 220 that is positioned at the very bottom of sump 138 along the vertical direction V. More specifically, sump 138 may define drain basin 220, which is a substantially cylindrical reservoir defined at the lowest portion of sump 138. Drain basin 220 may further define a discharge port 222 through which soiled wash fluid may be discharged from sump 138. More specifically, drain pump 202 is in fluid communication with discharge port 222 for selectively urging a flow of wash fluid through discharge port 222 and to external drain 204 during a drain cycle.

Notably, as explained above, the tendency of soiled wash fluid to flow back into drain basin 220 can have a negative impact on the wash performance of dishwasher appliance 100. Therefore, according to an exemplary embodiment the present subject matter, dishwasher appliance 100 further includes a check valve assembly 230 which is generally configured for preventing the backflow of soiled wash fluid into drain basin 220 or sump 138. Specifically, check valve assembly 230 includes a check valve 232 that is removably positioned over discharge port 222 between drain pump 202 and drain basin 220.

Figure 7:
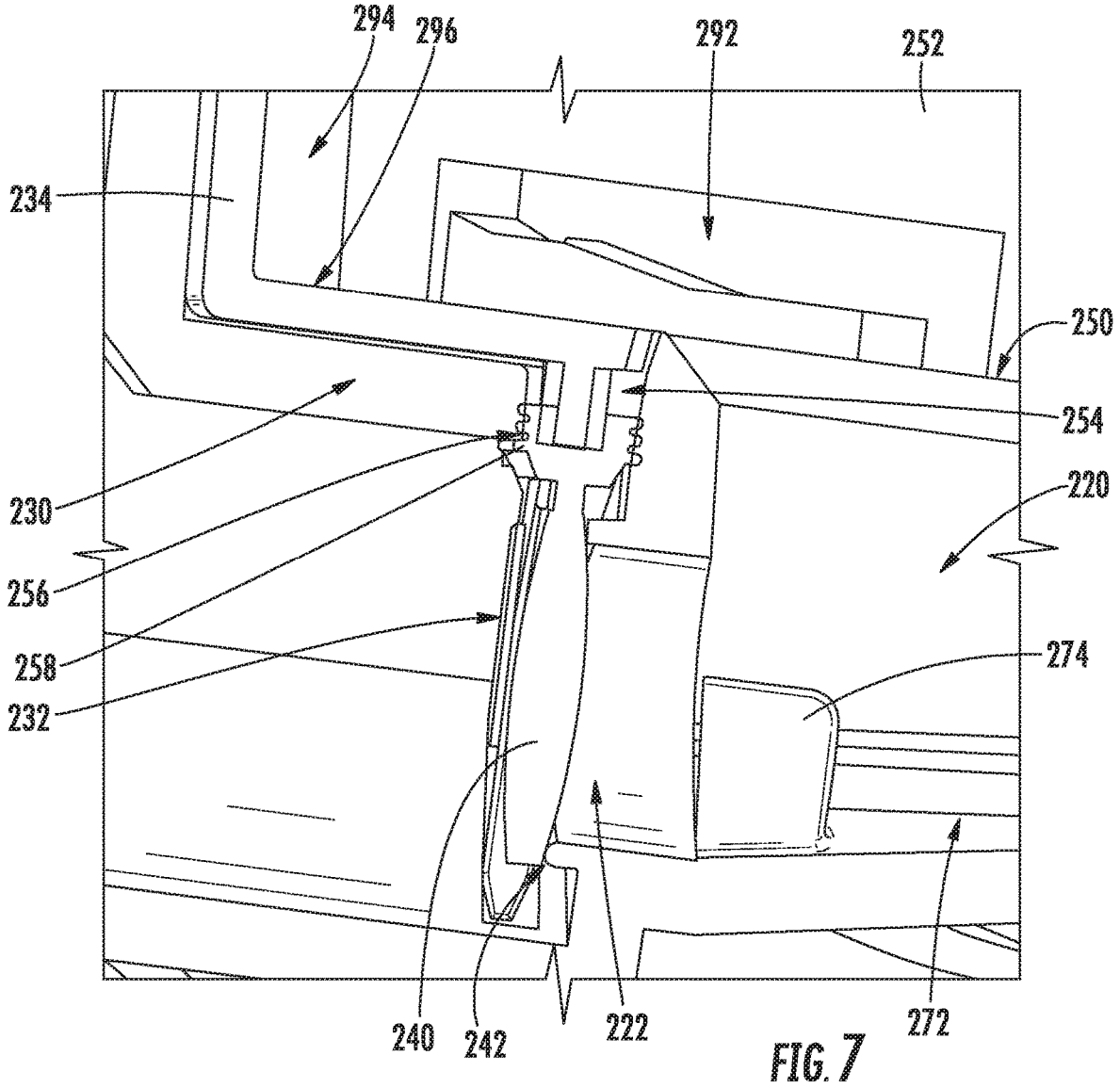
FIG. 7 provides a cross section view of a discharge port of the exemplary basin of FIG. 5 with the exemplary check valve assembly installed.
Figure 8:
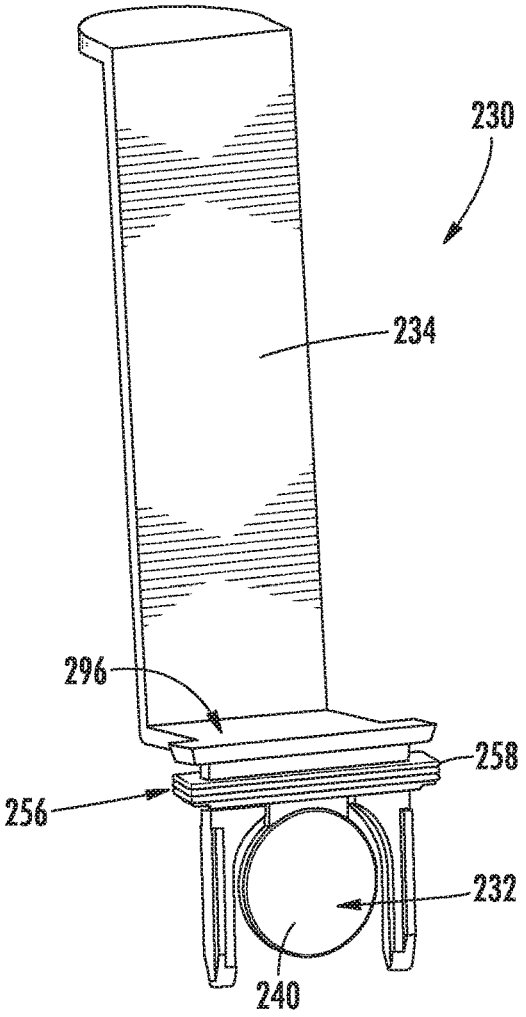
FIG. 8 provides a perspective view of the exemplary check valve assembly of FIG. 5.

In addition, check valve assembly 230 includes a positioning arm 234 which is attached to check valve 232 for positioning and locking check valve 232 in place over discharge port 222. According to the illustrated embodiment, check valve 232 comprises a resilient flap 240 that may pivot or flex between an open position to permit the flow of wash fluid and a closed position to prevent the flow of wash fluid. More specifically, as illustrated in FIGS. 4 and 7, resilient flap 240 is oriented vertically when in a closed position. Notably, check valve 232, or more specifically resilient flap 240, is positioned upstream of drain pump 202 such that drain pump 202 is positioned between the check valve 232 and drain hose 206. As described herein, positioning check valve 232 in this manner provides several advantages over prior art designs, such as the elimination of the backflow of soiled wash water, ensuring a continually primed pump, and noise reduction during operation.

During operation, resilient flap 240 prevents wash fluid from flowing from drain volute 210 through discharge port 222 and into drain basin 220. In this regard, to enhance the sealing effect of resilient flap 240, discharge port 222 defines a sealing surface 242 that protrudes from drain basin 220 toward drain pump 202. When wash fluid tries to reverse flow into drain basin 220, resilient flap 240 and forms a seal with sealing surface 242. By contrast when motor 212 is energized, the flow of wash fluid will cause resilient flap 240 flexible pivot upward to an open position where wash fluid may flow freely.

Referring again generally to FIGS. 4 through 9, positioning arm 234 is generally configured for facilitating the easy installation and/or removal of check valve 232. In this regard, positioning arm 234 generally extends vertically away from drain basin 220 and toward a top of sump 138. In this manner, in the event of a clog within drain basin 220, a user or maintenance technician can simply remove check valve assembly 230 by pulling up on positioning arm 234 to remove check valve 232. The user may then easily reach and remove clogs, e.g., within drain basin 202, within discharge port 222, within drain volute 210, or an inlet to drain volute 210.

Figure 5:
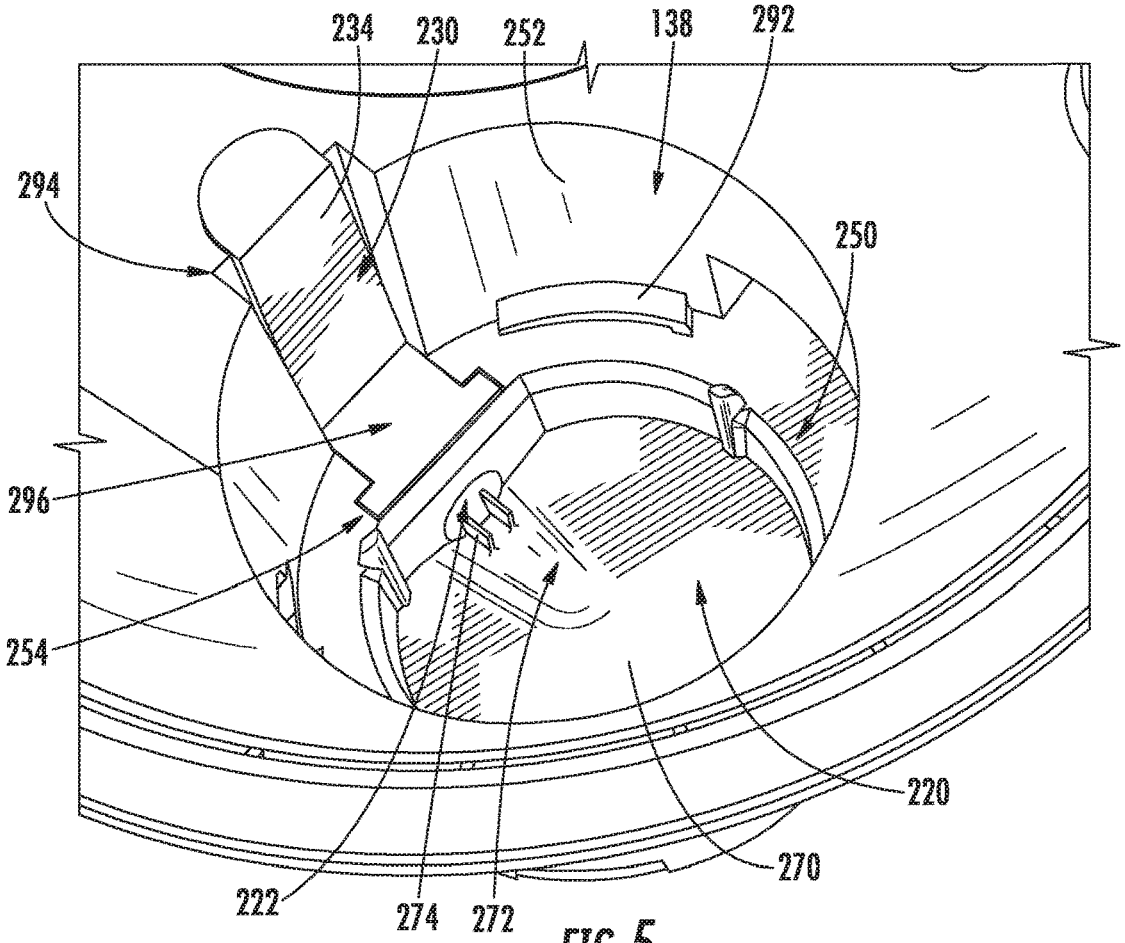
FIG. 5 provides a perspective view of a drain basin and a check valve assembly of the exemplary sump assembly of FIG. 3.
Figure 6:
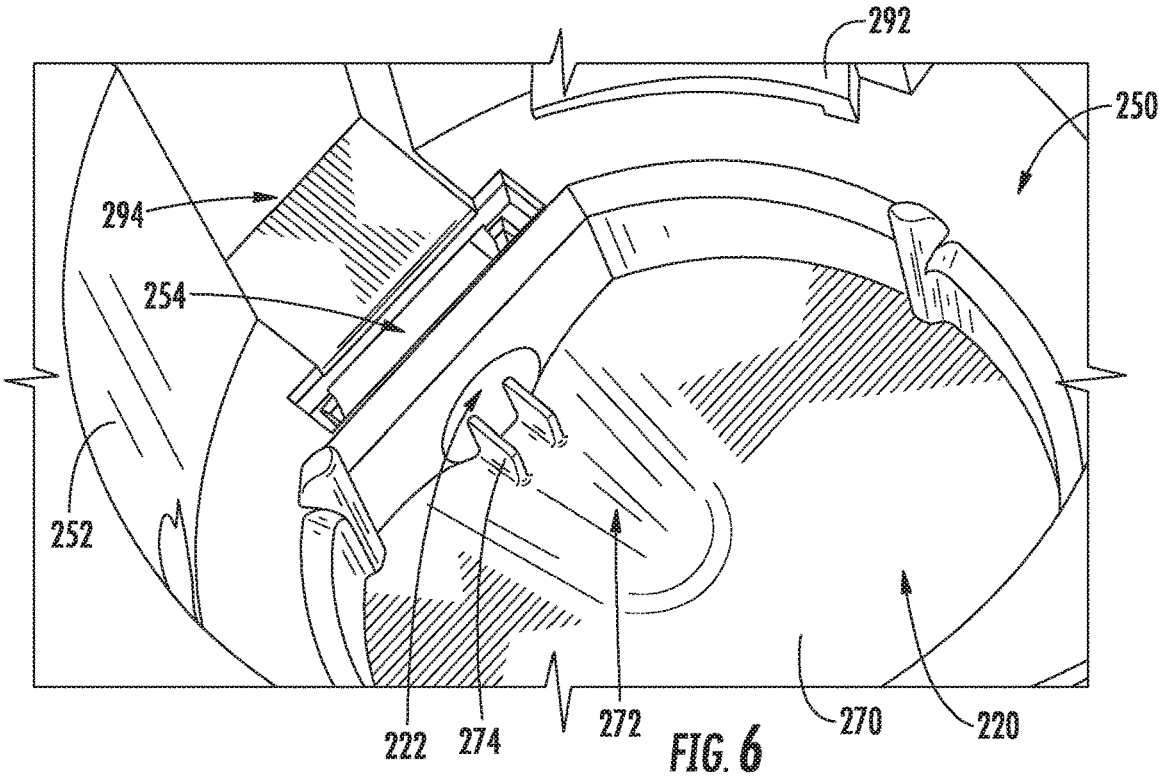
FIG. 6 provides a perspective view of the exemplary drain basin of FIG. 5 with the exemplary check valve assembly removed.

Notably, dishwasher appliance 100 and sump 138 may define various features to facilitate the simple and effective installation and removal of check valve assembly 230. For example as best illustrated in FIGS. 4 through 6, sump 138 may define a shoulder 250 that surrounds drain basin 220 at a top of drain basin 220. More specifically, sump 138 may define a sump wall 252 is generally positioned around and above drain basin 220. Shoulder 250 may generally extend along a horizontal direction to connect the top of drain basin 220 to sump wall 252.

Figure 9:
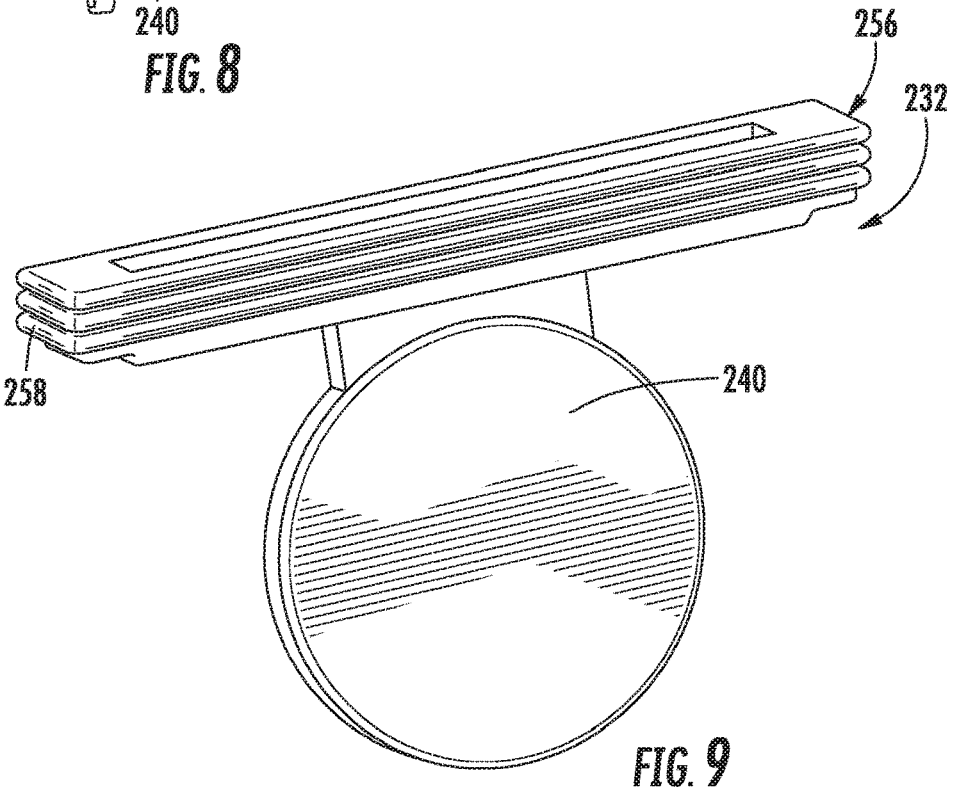
FIG. 9 provides a perspective view of a check valve of the exemplary check valve assembly of FIG. 5.

As best shown in FIG. 6, sump 138, or more specifically shoulder 250, may further define a slot 254 is generally positioned above discharge port 222. In this manner, slot 254 generally provides fluid communication between sump 138 and drain volute 210. However, slot 254 is not intended to pass wash fluid, but is instead configured for receiving check valve 232. More specifically check valve 232 extends through slot 254 and into positioned adjacent discharge port 222. Notably check valve 232 further defines an auxiliary sealing surface 256 that is configured for engaging sump 138 around slot 254 to provide a fluid seal and prevent wash fluid from passing through slot 254. As best shown in FIG. 9, auxiliary sealing surface 256 may be a substantially rectangular seal having a plurality of protruding ribs 258 to enhance the sealing effect.

Positioning arm 234 and check valve 232 may be formed using any suitable material or materials. For example, because check valve 232 includes a resilient flap 240 and defines an auxiliary sealing surface 256, check valve 232 may preferably be formed using silicone or similar resilient rubber material. By contrast, because positioning arm 234 is used for installing or removing check valve 234, it is preferably formed from a rigid plastic material. According to an exemplary embodiment, positioning arm 234 is injection molded from a rigid plastic and then check valve 232 is over molded onto positioning arm 234 using silicone. In this manner, check valve assembly 230 is a single part that may be easily used to remove and install check valve 232.

As best illustrated in FIGS. 4 through 6, drain basin 230 is positioned and designed to improve the drain cycle and effectively discharge all wash fluid within sump 138. In this regard, drain basin 220 is defined in part by a bottom wall 270 that is positioned proximate a lowest point within dishwasher appliance 100. In addition, drain basin 220 defines a recessed trough 272 that drops below bottom wall 270 for collecting the last amount of wash fluid. In addition, discharge port 222 is positioned adjacent or defined in part by recessed trough 272. In this manner, discharge port 222 and check valve 232 are positioned at a very bottom of drain basin 220 and sump 138. In addition, drain pump 202 and drain volute 210 may be positioned adjacent discharge port 222 along the vertical direction V.

In addition, drain basin 220 may define one or more soil management fins 274 for preventing the passage of large food particles or soil through discharge port 222, e.g., to prevent or minimize the potential for clogs. In this regard, soil management fins 274 extend from bottom wall 270 or recessed trough 272 upward along the vertical direction V and are positioned upstream of the discharge port 222. Notably, because soil management fins 274, discharge port 222, and check valve 232 create the largest restriction within the drain system of dishwasher appliance 100, clogs are more likely to form at this location than elsewhere within dishwasher appliance 100, such that they may be easily diagnosed and removed.

Referring again to FIGS. 3 through 7, dishwasher appliance 100 may further include a system of filters that are generally configured for preventing food particles from entering drain pump assembly 200 to reduce the likelihood of clogs. More specifically, dishwasher appliance 100 may include a coarse filter 280 that is positioned along a top wall of sump 138 and is generally configured for filtering large particles or food soil. In addition, dishwasher appliance may include a fine filter 282 that is generally configured for removing smaller particles or food soil. As used herein, "food particles" refers to food soil, particles, sediment, or other contaminants in the wash fluid which are not intended to travel through filters 280, 282. According to an exemplary embodiment, coarse filter 280 is constructed from a perforated stainless steel plate. For example, coarse filter 280 may generally include a plurality of perforated holes, e.g., approximately 15/1000 of an inch in diameter, such that wash fluid may pass through, but food particles entrained in the wash fluid do not. In addition, fine filter 282 may be a substantially cylindrical conical fine mesh filter for filtering finer particles. However, according to alternative embodiments, filters 280, 282 may be any structure suitable for filtering food particles from wash fluid passing therethrough.

According to the illustrated embodiment, fine filter 282 is also used to lock check valve assembly 230 in position, as described below. In this regard, fine filter 282 defines an annular bottom support member 290 that is generally configured for locking positioning arm 234 and check valve 232 in position when seated against shoulder 250. Moreover, as shown in FIGS. 5 through 7, sump 138 may define one or more tapered locking ribs 292 that are configured for engaging support member 290 to lock fine filter 282 in place when fine filter 282 is seated on shoulder 250 and rotated.

According to the illustrated embodiment, sump wall 252 defines a recessed slot 294 that is configured for receiving positioning arm 234 such that it does not protrude into sump 138. Thus, positioning arm 234 may define a bend 296 which sits flush with shoulder 250 to prevent any interference with support member 290 seating on shoulder 250. According to an exemplary embodiment, to remove check valve assembly 230, a user would rotate fine filter 282 counterclockwise and pull up to remove it from sump 138. A user can then access screws (not shown) to remove coarse filter 280 from sump 138 before pulling up on positioning arm 234 to remove check valve assembly 230. After a clog is cleared, the process may be reversed for installing check valve assembly 230 and filters 280, 282.

Check valve assembly 130 described above is removable and is positioned upstream of the drain pump, e.g., between a discharge port of the drain basin and the drain volute. Notably, such positioning eliminates soiled wash fluid from flowing back into the drain basin where it would be recirculated within the wash chamber. In this regard, during a drain cycle, the flapper on the check valve is opened by the pressure of the flow of draining wash fluid. However, after the drain cycle is complete, the pressure from wash fluid remaining the high drain loop forces the flapper closed, thereby sealing the dishwasher from the previously drained soiled wash fluid.

In addition, check valve assembly 130 simplifies the removal of clogs when they occur. In this regard, clogs may be removed inside of the dishwasher instead of requiring the removal of the entire dishwasher from the cabinet. More specifically, the check valve can be accessed and clogs may be removed by opening the door, removing the fine filter and coarse filter to expose the check valve assembly in the sump, and removing clogs. After the check valve is removed, the clog may be easily cleared before reinstalling the check valve. Notably, because the discharge port of the drain basin is the tightest restriction on the drain system, the likelihood of clogs downstream of the check valve is minimal, thereby reducing the need for frequent service visits.

Additionally, by placing the check valve on the sump side of the drain pump, e.g., proximate the drain basin, the drain pump stays hydraulically primed, thereby minimizing the opportunity for the drain pump to become "air locked." It also eliminates the need to pulse the drain pump on and off when activated to remove air from the volute of the drain pump, which improves sound quality. In sum, check valve assembly 100 described herein leads to better wash performance, improved efficiency, simplified maintenance, and improved user satisfaction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical direction, the dishwasher appliance comprising:
- a wash tub that defines a wash chamber;
- a sump for collecting wash fluid;
- a drain basin defined at a bottom of the sump, the drain basin defining a discharge port;
- a drain pump in fluid communication with the discharge port for selectively urging a flow of wash fluid through the discharge port to an external drain during a drain cycle; and
- a check valve assembly comprising:
  - a check valve removably positioned over the discharge port between the drain pump and the drain basin; and
  - a positioning arm attached to the check valve for positioning and locking the check valve in place, the positioning arm extending away from the drain basin along the vertical direction toward a top of the sump.

2. The dishwasher appliance of claim 1, wherein the positioning arm is injection molded from a first material and the check valve is overmolded onto the positioning arm using a second material.

3. The dishwasher appliance of claim 2, wherein the first material is plastic and the second material is silicone.

4. The dishwasher appliance of claim 1, wherein the sump defines a slot above the discharge port, the check valve extending through the slot into position adjacent the discharge port.

5. The dishwasher appliance of claim 4, wherein the check valve assembly further comprises an auxiliary sealing surface that forms a fluid seal with the slot to prevent wash fluid from passing through slot.

6. The dishwasher appliance of claim 1, wherein the dishwasher appliance further comprises a fine filter that locks the check valve assembly in place when installed.

7. The dishwasher appliance of claim 6, wherein the sump defines a shoulder that surrounds the drain basin at a top of the drain basin, and wherein the fine filter is seated on the shoulder to lock the positioning arm and the check valve in place.

8. The dishwasher appliance of claim 7, wherein the sump defines one or more tapered locking ribs for locking the fine filter in place when the fine filter is seated on the shoulder and rotated.

9. The dishwasher appliance of claim 1, wherein the sump defines a sump wall and a recessed slot defined in the sump wall for receiving the positioning arm.

10. The dishwasher appliance of claim 1, wherein the discharge port defines a sealing surface facing toward the drain pump, the check valve configured for engaging and creating a fluid seal with the sealing surface.

11. The dishwasher appliance of claim 10, wherein the check valve is a resilient flap that pivots open when wash fluid is moving from the drain basin to the drain pump, but which is forced closed when wash fluid tries to enter the drain basin.

12. The dishwasher appliance of claim 11, wherein the resilient flap is oriented vertically in a closed position.

13. The dishwasher appliance of claim 1, wherein the check valve is positioned upstream of the drain pump such that the drain pump is positioned between the check valve and a drain hose.

14. The dishwasher appliance of claim 1, wherein the drain pump comprises a drain volute, and wherein the check valve is positioned at a bottom of the drain volute along the vertical direction.

15. The dishwasher appliance of claim 1, wherein the positioning arm extends vertically outside of the drain basin and the sump.

16. The dishwasher appliance of claim 1, wherein the drain basin further defines a soil management fin, the soil management fin extending from a bottom wall upward along the vertical direction and being positioned upstream of the discharge port.

17. The dishwasher appliance of claim 1, wherein a bottom wall of the drain basin defines a recessed trough such that the discharge port is defined at least in part below the bottom wall of the drain basin.

18. A drain pump assembly for a dishwasher appliance, the drain pump assembly comprising:

a drain basin defined at a bottom of a sump of the dishwasher appliance, the drain basin defining a discharge port;

a drain pump in fluid communication with the discharge port for selectively urging a flow of wash fluid through the discharge port;

a check valve removably positioned over the discharge port between the drain pump and the drain basin; and a positioning arm attached to the check valve for positioning and locking the check valve in place, the positioning arm extending away from the drain basin along a vertical direction toward a top of the sump.

19. The drain pump assembly of claim 18, wherein the sump defines a slot above the discharge port, the check valve extending through the slot into position adjacent the discharge port, and wherein the check valve defines an auxiliary sealing surface that forms a fluid seal with the slot to prevent wash fluid from passing through slot.

20. The drain pump assembly of claim 18, wherein the sump defines a shoulder that surrounds the drain basin at a top of the drain basin, and wherein the dishwasher appliance further comprises a fine filter that locks the check valve assembly in place when installed.

* * * * *